US005155909A

United States Patent [19]

Murray et al.

[11] Patent Number: 5,155,909

[45] Date of Patent: Oct. 20, 1992

[54] PRESS ROLL APPARATUS AND METHOD OF CONSTRUCTION

[75] Inventors: Donald C. Murray, Graniteville; Gerald E. Parrott, Barre Town, both of Vt.

[73] Assignee: Rock of Ages Corporation, Barre, Vt.

[21] Appl. No.: 714,637

[22] Filed: Jun. 13, 1991

[51] Int. Cl.[5] ..... B23P 17/00; B21B 31/08

[52] U.S. Cl. ..... 29/895.212; 29/895.22; 29/447; 29/119; 29/123

[58] Field of Search ..... 29/895.212, 895.22, 29/447, 119, 123, 132

[56] References Cited

U.S. PATENT DOCUMENTS

| | | | |
|---|---|---|---|
| 2,693,670 | 11/1954 | Perry | 29/123 |
| 3,635,637 | 1/1972 | Bergendahl | 29/447 X |
| 3,737,962 | 6/1973 | Hill . | |
| 3,807,012 | 4/1974 | Loquist | 29/895.212 X |
| 3,833,982 | 9/1974 | Paulin | 29/447 X |
| 4,272,873 | 6/1981 | Dietrich . | |
| 4,399,598 | 8/1983 | Page et al. . | |
| 4,642,862 | 2/1987 | Muhle et al. . | |
| 4,658,486 | 4/1987 | Schonemann | 29/123 |
| 4,924,688 | 5/1990 | Cutmore . | |
| 4,991,275 | 2/1991 | Adams, Sr. . | |
| 5,040,398 | 8/1991 | Nakagawa et al. | 29/123 X |

FOREIGN PATENT DOCUMENTS

| | | | |
|---|---|---|---|
| 567516 | 8/1977 | U.S.S.R. | 29/895.22 |

OTHER PUBLICATIONS

Vestola et al., *Granite Rolls—Failures, Their Prevention and Substitute Materials,* Proceedings of the 1989 Annual Meeting, CCPA, Montreal, Canada, B109 (Feb. 3, 1989).

*Precision Granite Products Brochure,* Rock of Ages Corporation, Precision Granite Products Division, available from P.O. Box 482, Barre, Vt., 05641.

*Dywidag Threadbar Posttensioning System Brochure,* available from Dywidag Systems International of New Jersey, U.S.A.

*Primary Examiner*—Timothy V. Eley

*Attorney, Agent, or Firm*—Mason, Fenwick & Lawrence

[57] ABSTRACT

A press roll assembly having no substantial circumferential stress at operating temperature due to differential thermal expansion of the head and roller material is disclosed. In a preferred embodiment, the assembly is formed from a granite roll having opposed parallel substantially planar ends compressed between steel heads; the steel heads are preferably heated to the maximum operating temperature of the press roll assembly prior to tensioning against the press roll held at ambient temperature. Preferably, there is a rectilinear interface between the heads and the roll, and preferably the heads are tensioned against the ends of the roll by tie-rods connected to the opposed heads through a plurality of longitudinal bore holes passing through the roll and heads, the bores being disposed radially outward and parallel to the axis. Upon cooling of the heads, radial compression is induced in the ends of the roll. Upon heating of the press roll assembly, the circumferential stress caused by differential thermal expansion of the heads and press roll will be offset by the radial compression.

20 Claims, 1 Drawing Sheet

PRESS ROLL APPARATUS AND METHOD OF CONSTRUCTION

FIELD OF THE INVENTION

This invention is directed to improved press rolls, and more particularly is directed to improved press rolls and a method of making same having induced radial compression in the press roll to counteract the effects of differential thermal expansion of the roll body and the metal flanges or heads on the ends of the roll body.

BACKGROUND OF THE INVENTION

Press rolls, and in particular granite press rolls, are useful in paper making and cardboard manufacturing machines, in addition to having other uses. Generally, the press rolls are held in press roll apparatus or assemblies by steel heads or flanges which are rotatably supported by journals. The mechanical stress and temperature fluctuations which the rolls are placed under in industrial uses can lead to axial cracking, circumferential fracture, or fatigue failure of the granite roll body.

The most catastrophic press roll failures have resulted from axial cracking, which stems basically from thermally induced tension in the stone primarily caused by greater thermal expansion of the steel heads engaging the ends of the granite roll which has a much lower coefficient of thermal expansion than steel. Consequently, expansion of the heads causes circumferential tension stresses in the press rolls. Additionally, the likelihood of catastrophic failure of press rolls increases in modern, high-speed machines in which higher temperatures and centrifugal forces increase tension on the roll.

Vestola, et al., in *Granite Rolls—Failures Their Prevention and Substitute Materials,* Proceedings of the 1989 Annual Meeting CCPA, Montreal, Canada, B-109 (1989), teach that shaft failure can be avoided by proper design, and that circumferential fracture can be reduced by appropriate dimensioning and pretensioning. However, there remains a need to eliminate the source of the most catastrophic press roll failures—axial cracking caused by circumferential or hoop stress.

Vestola, et al. indicate that granite rolls having shafts fitted tightly into a bore in the roll, or shafts surrounded by concrete grouting, will generally have a high hoop stress at the inner surface of a granite roll when there is a rapid temperature rise in the shaft; such rapid temperature rise could be due to heating of the shaft caused by friction or mechanical malfunction. However, even where the shaft is not fitted tightly, or in a non-grouted roll, Vestola, et al. teach that stress in granite press rolls can not be totally eliminated; this belief is based on the principle that differential thermal expansion of the metallic heads at the roll ends will cause circumferential stresses at the ends of the granite roll. The circumferential stress is believed to be due to the fact that the heads will radially expand faster than the roll ends due to the higher coefficient of thermal expansion of the steel forming the heads than that of the roll material (usually granite) and that there is great friction between the granite roll and the steel heads, so that relative movement (slippage) of the head flanges in contact with the roll end surfaces is not possible.

A prior art solution to the radial expansion problem of press rolls involved compression of a roll having opposed male conical shaped ends matingly engaged with matching conical female surfaces on steel heads. With reference to FIG. 1, one end of such a prior art press roll is illustrated, with it being understood that the opposite end of the press roll is substantially a mirror image thereof. A press roll 2, made of granite or other like suitable material, is axially aligned and concentric about a shaft 4 which passes through bore 6. A centering ring 8 ensures that shaft 4 is radially centered in roll 2 about the axis of rotation. Press roll 2 terminates in tapered conical surface 10.

A compression head 12 is connected relative to shaft 4, and includes an annular ring 14, a portion of which is pressed against the male tapered conical end surface 10 of press roll 2. The inner surface 16 of annular ring 14 is a tapered conical surface identical to and making surface to surface contact with the male tapered conical surface 10 so as to create a smooth and continuous interface Axial force exerted against the heads presses the heads against the tapered conical ends of a press roll, to create radial force against the stone and create radial compression and stress in the press roll.

Compression of the heads prior to assembling the press roll apparatus can be achieved by extending the length of the shaft by heating the shaft relative to the press roll and then cooling of the shaft, which will induce both longitudinal (axial) and radial compression in the press roll. An example of such a method and apparatus is shown by Hill in U.S. Pat. No. 3,737,962. It is also possible to use one or more tie-rods, threadbars, or cables in place of, or in addition to, a central shaft for inducing tension between opposed press roll heads. See Muhle et al., U.S. Pat. No. 4,642,862. Further, a solid roll having opposed male tapered ends can be compressed between two female heads which are compressed by a force external to the roll.

U.S. Pat. No. 4,924,688, to Cutmore, and U.S. Pat. No. 4,991,275, to Adams, Sr., also show roller assemblies having rolls with male tapered ends which are placed in axial compression by hubs or collars having inner surfaces tapered at an angle to match the tapered ends of the roll. All references cited herein are incorporated by reference as if reproduced in full below.

The nature of the compressive forces created in a roll by the prior art methods is more easily understood by referring back to FIG. 1. Longitudinal compression in shaft 4, illustrated by force line 18, is transformed into a smaller longitudinal component 20 and a radial compression component 22 due to the non-rectilinear interface between the female tapered end 10 of press roll 2 and the male tapered or bevelled inner surface 16 of compression head 12. Upon heating of a roll having a male tapered end compressed between opposed female tapered or conical heads, the longitudinal compression component may be reduced due to greater longitudinal expansion of the shaft with respect to the length of the roll; this longitudinal expansion of the shaft may be offset by longitudinal expansion of the head and roll body. However, the head also expands radially outward, and friction between the head and the roll end ma contribute to circumferential stress in the roll.

Further, conical shaped granite roll ends and their complimentary steel heads are difficult to manufacture, especially with any degree of precision; failure to achieve a smooth interface between tapered roll ends and tapered heads can result in asymmetric compression of the roll which can lead to cracking of the roll or otherwise shorten the life of the roll. Further, differential thermal expansion of the steel heads, internal shaft (if used), and centering rings (if used) induce stress in the press roll.

The difficulties in machining tapered press roll ends and in manufacturing complimentary conical roll heads creates the need for a method for inducing radial compression in press rolls having a rectilinear interface between the roll ends and heads or clamping plates. There is also a need for a press roll in which circumferential stress, induced by differential thermal expansion of the roll heads, internal shaft (if used), and centering ring (if used), is substantially eliminated at the operating temperature of the press roll.

Thus, it is a primary object of the present invention to manufacture a press roll apparatus having a rectilinear interface between the ends of the roll and the heads which has no substantial circumferential stress at operating temperature.

It is a further object of the present invention to provide a method of constructing press roll apparatus which have a rectilinear interface between the roll and the heads and which have no substantial circumferential stress at operating temperature.

SUMMARY OF THE INVENTION

These and other objects of the present invention are achieved by a method of constructing press roll apparatus, and by the resulting press roll assemblies, which utilize the higher compressive strength of the roll material, preferably granite (which can withstand a maximum compressive stress of approximately 25,000 psi but only has a tensile strength of 1500 psi), and radial precompression. Preferably, steel heads having a higher coefficient of expansion than granite are heated to a temperature higher than the roll, and are forcefully urged against the roll ends by longitudinal post-tension developed by tensioning steel tendons which extend through bores in the roll and connect with the heads. The high reactive force between the steel heads and the roll ends creates a high friction juncture between these two elements so that any radial expansion or contraction of the head will not result in slippage of the head relative to the granite, but will instead result in the application of substantial force to the roll and create a high stress in the roll. Thus, radial compression is developed in the roll as the steel heads cool.

The radial compression cancels subsequent tensile, hoop, or circumferential stress which develops in the roll during use of the roll, which results from increased thermal expansion of the steel heads relative to the roll during operation of the device. Thus, radial compression can be induced in press rolls having a planar interface between the roll ends and the heads, and this radial compression is used to offset or cancel stress caused by differential thermal expansion between the roll ends and the heads.

DETAILED DESCRIPTION OF THE INVENTION

Figure 1:
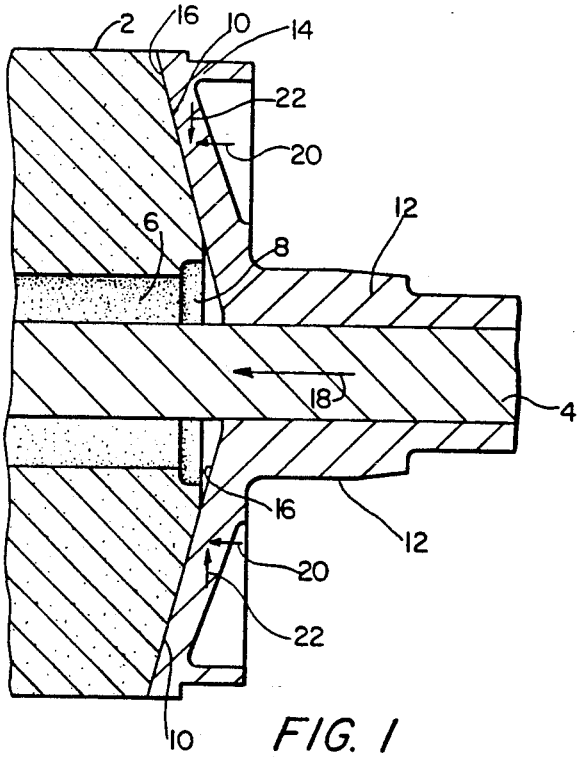
FIG. 1 PRIOR ART
FIG. 1 is a partial cross-sectional view of a prior art press roll having a roll with a male tapered end interfaced with a female tapered head.
Figure 2:
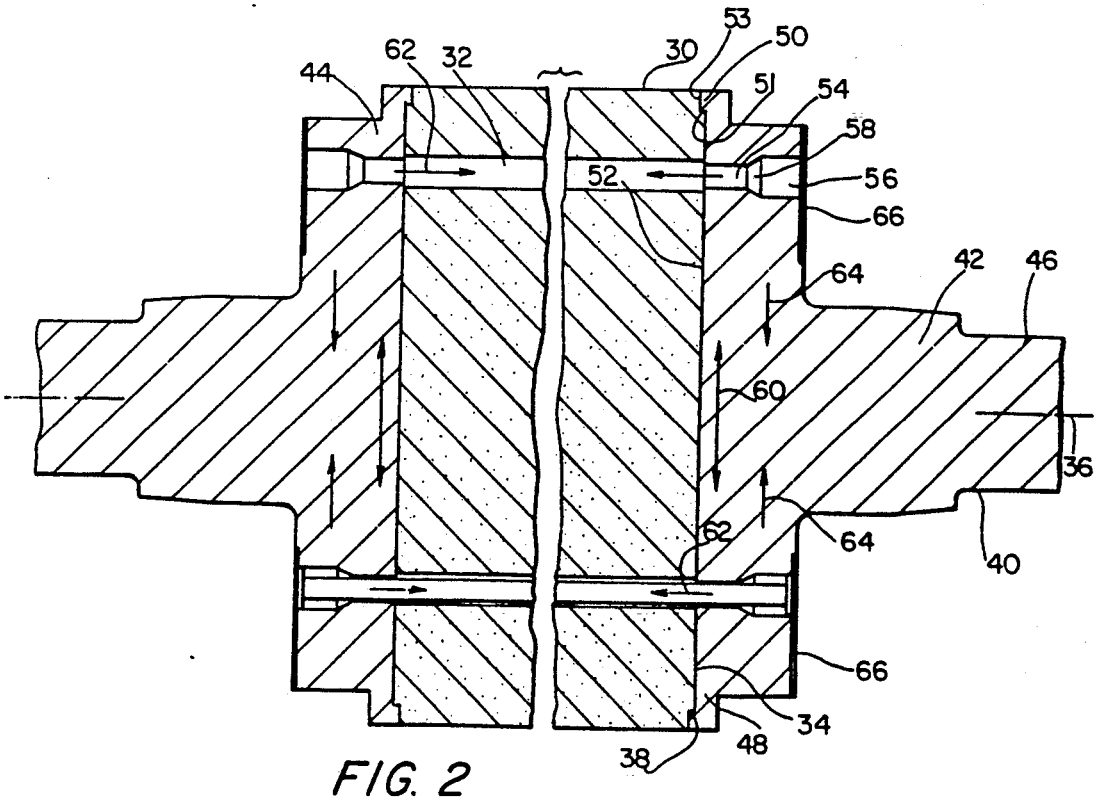
FIG. 2 is a transverse cross-sectional view of a preferred embodiment of a press roll apparatus constructed in accordance with the present invention.

With reference to FIG. 2, a preferred embodiment of the present invention comprising a press roll assembly is illustrated in cross-section. Reference may primarily be made to one end, since it is understood that one end is essentially a mirror image of the other. Press roll 30 is preferably made of granite, and contains a plurality of axially parallel longitudinal bore holes 32 positioned outwardly of the axis 36 of roll 30 which extends from radial planar end surface 34 to an opposite radial planar end surface of roll 30.

Roll end surface 34 is substantially planar, and includes an annular rim shoulder 38 about its outer periphery. Head 40 is preferably made of steel and includes a hub 42 which is substantially cylindrical in shape. Hub 42 is integrally formed with a cylindrical flange or plate 44, and is also shaped to include an axially centered shaft or journal 46 for rotatably supporting the press roll. [Hence, it is preferred to use heads comprising an integral shaft and flange.]

Hub 42 may be tapered to provide additional support to plate 44, or to reduce the amount of material used to form head 40. Reinforcing plate 44 is integrally connected to a disk 48, having a rim lip 50 defined by cylindrical inwardly facing surface 51 and planar radial surface 53 about its outer periphery. A plurality of bores 54 pass through disk 48 and plate 44. The outer surface 52 of disk 48 is substantially planar, and disk 48 has a circumference which, when thermally expanded, equals the circumference of roll 30 so that lip 50 of disk 48 will fit into peripheral shoulder 38 to form a smooth rectilinear interface between roll end 34 and inwardly facing surfaces 51, 52 and 53 of disk 48. Lip 50 and shoulder 38 are primarily used to center head 40 on roll end 34; however, their use is not mandatory and they can be dispensed with so that purely planar roll and head engaging surfaces could be employed without detriment. Further, it is not critical that the diameter of disk 48 be equal to the diameter of the roll 30. In practice, disk 48 may be substantially larger or smaller in diameter than roll 30; in addition, a gap may be formed between surface 51 of lip 50 and surface 38 of shoulder 38 without detriment. Reinforcing plates 44 may also be dispensed with so that the heads comprise flanges or disks 48 alone, which may be integrally connected to a shaft or journal, or which may be rotatably supported by other conventional techniques.

The roll assembly process begins with the heating of both head members 40 to just below the maximum operating temperature that the press roll will be subjected to during use. Greater or lesser temperatures than the maximum operating temperature can be used, depending on the ultimate stress which the roll will be under. It is not necessary to heat the heads to the maximum operating temperature to substantially cancel circumferential stress in the roll ends caused by differential thermal expansion since the rolls will expand slightly. The heads 40 are then placed in position at the ends of roll 30, and tendons or other conventional tension creating devices are positioned in bores 32, 54 and tensioned to press the heads against the end surfaces of the roll with sufficient force that there will be great frictional resistance to head slippage or to the movement of the heads with respect to the roll ends in a direction perpendicular to the axis of rotation.

Note that during the assembly process, the heated heads 40 are aligned against roll ends 34 so that the plurality of bore holes 32 in roll 30 are aligned with an equal number of bores 54 passing through disks 48 and reinforcing plates 44. Bores 54 terminate with recesses 56 which are wider in diameter than bores 54 and include tapered frustoconical bottoms 58.

Conventional tension creating devices include threadbars, tie-rods, or cables which are inserted in aligned bores 54, 32. Conically bevelled retaining clamps or seats for clamping nuts are connected to the ends of conventional tendons or cables; conventional apparatus and techniques for tensioning heads (clamping or end plates) to axial ends of roller bodies to create axial stress in the roller bodies are disclosed in U.S. Pat. Nos. 4,642,862 and 4,272,873. A cover plate 66 also be provided in a preferred embodiment to cover recesses 56. By tensioning the tie-rods or cables, head 40 is engaged with end 34 of press roll 30, and, accordingly, the opposite head is engaged with the opposite roll end.

During the first step in the roll assembly, which comprises the heating of heads 40 to a temperature greater than the press roll, a radial expansion of heads 40 occurs, represented by arrow 60. The heated heads 40 are then engaged with the ends 34 of roll 30 with the bores 32 and 54 being aligned. The subsequent tensioning step presses the heads against the ends of roll 30, as represented by force arrows 62. As the heads subsequently cool, they contract, and the contraction, represented by arrows 64, induces radial compression of the ends of the roll due to high friction between roll end surface 34 and head surface 52. If there is a tight or snug fit between lip 50 and shoulder 38, lip 50 may contract about shoulder 38 to slightly increase the area of radial compression.

Thus, in ambient temperatures, the press roll is under radial compression. Upon heating of the press roll during use, the radial compression on the press roll will gradually decrease as the heads expand radially at a greater rate than the roll due to the higher coefficient of thermal expansion of the steel head. Since the heads are heated to a temperature just beneath the operating temperature, there will be substantially no net outward radial force at operating temperature caused by thermal expansion of the head relative to the roll. In fact, by increasing the temperatures which the heads are exposed to prior to assembly of the press roll apparatus, the roll can be in compression when at operating temperature to further reduce the chance of catastrophic failure of the press roll assembly due to axial cracking from circumferential stress.

Note that the high compressive strength of rolls formed from granite minimizes the chances that the radial compression at ambient and operating temperatures will result in cracking or crushing of the roll; however, the low tensile strength of granite and similar materials requires that radial tension be avoided, a result clearly achieved by the subject invention.

The improved press roll assembly of the present invention is ideally suited for use in paper making machines, and for similar uses. While it is preferred to use a solid cylindrical roll of granite having a plurality of radially disposed bore holes passing therethrough and associated tendons, it is also possible to use the preheated head concept of the present invention with rolls having a central bore which are longitudinally compressed by a solitary axial shaft, which is in tension so as to pull the opposed heads toward each other to hold the roll in axial compression, provided the opposed heads have been heated above the operating temperature prior to assembly of the roll and heads.

The heads ma be made of other high strength materials than steel, such as other metals and/or alloys which may or may not include iron. It is also contemplated that the method of the present invention, preheating the heads before tensioning the heads against the ends of a roller held at ambient temperature, may be used with rolls having tapered ends and with heads of matching conical shape. Further, the length, diameter, and weight of the roller used, along with other dimensions and shapes of the head and roller used may be varied as would be obvious to one of skill in the art.

With regard to the number of tie-rods or tendons used, this will vary with the length, size, and weight of the roll used and will depend on the bending stress which the press roll will be subjected to. Adjustment of the number of tie-rods used and adjustment of the tension in the tie-rods to the optimum number and tension, will be readily accomplished by those of skill in the art without undue experimentation.

Although construction of a pres roll assembly in accordance with the present invention can be easily performed by one of skill in the art based on the above teachings, to further clarify the invention the following nonlimiting example is provided of a press roll assembly constructed according to the present invention, and used in a paper making machine; the press roll assembly was used to replace a prior art roll which failed due to axial cracking.

EXAMPLE 1

A granite roll having a diameter of 1500 mm and a length of 7850 mm had 30 longitudinal bore holes of two and three-eighths (2 $\frac{3}{8}$) inch diameter drilled therein. The bores were disposed in two concentric circles radially spaced from and centered about the roll axis. Ten bores were arranged in a 700 mm diameter bolt circle and the remaining bore holes were formed in a circle having a diameter of 1155 mm. Thirty tendons were inserted into the bore holes and used to urge two steel heads toward each other to forcefully engage the opposite ends of the granite roll; the heads have a diameter of 1500 mm at the point of contact with the roll ends.

A preferred source of granite rolls is ROCK OF AGES located in Barre, Vt. The tendons are preferably made from one and three-eighths (1$\frac{3}{8}$) inch continuous thread bars available from Dywidag Systems International of New Jersey, U.S.A. (Note that other tendon constructions, such as steel rods, cables, or any other equivalent means can be used for tensioning the heads.)

The heads were preheated to about the maximum operating temperature which the press roll assembly would be subjected to, and the heated heads were tensioned to the ends of the ambient temperature roll. The completed press roll assembly was then installed in a paper making machine where it presses against two other rolls. The roll was designed to handle a 700 pound per linear inch, pli, pressure at 110° and 800 pli at 330° (these pressures are otherwise referred to as nip load or line pressure).

Other rolls of varying dimensions and having varying performance specifications have been constructed and installed in industrial machines with no reports of axial cracking.

Thus, although the present invention has been described by referring to a preferred embodiment thereof, many variations and modifications will be apparent to those of skill in the art. Therefore, the present invention should in no way be limited to the specific embodiments disclosed herein.

What is claimed is:

1. A method for constructing a press roll assembly, comprising the steps of:

heating a pair of heads to a first temperature;

pressing said heads heated to a first temperature against the opposed ends of a cylindrical roll and retaining said heads pressed against the opposed ends of said cylindrical roll, said roll being at a temperature lower than said first temperature and having a coefficient of thermal expansion less than the coefficient of thermal expansion of said heads; and allowing said heads to cool to induce radial compression in said roll.

2. A method according to claim 1, wherein:

said heads comprise metal members having a disk-shaped portion, and said roll comprises stone, wherein said roll and said members have a plurality of axially parallel longitudinal bores; at least some of said bores in said members being aligned with at least some of said bores in said stone roll; wherein:

said pressing step comprises the steps of:

placement of tension means in at least some of said aligned bores;

engaging the opposite ends of said tension means with said members to interconnect said members; and creating tension in said tension means so that said cylindrical stone roll is placed in longitudinal compression by reaction against said members.

3. The method of claim 1, wherein:

said heads comprise members having a disk-shaped portion coaxially positioned relative to said cylindrical stone roll, and said cylindrical stone roll and said members have a plurality of aligned longitudinal bores; wherein:

said pressing step comprises the steps of:

placing elongated tendon means having first and second ends in at least some of said aligned bores:

engaging said first and second ends of said tendon means with said members: and creating tension in said tendon means so that said cylindrical stone roll is placed in longitudinal compression by said members, and wherein:

the material forming said cylindrical stone roll is granite; and the material forming said members is steel.

4. A method according to claim 1, wherein:

said tension means comprises tendon members each having reaction means at each end for engaging and applying force to said heads for urging said heads toward each other.

5. A method according to claim 1, wherein:

said first temperature is selected so that said assembly will have substantially no circumferential stress when said assembly is heated to an operating temperature which approximately equals said first temperature.

6. A press roll assembly, comprising:

roll means having first and second end surfaces; and head means engaged with said end surfaces of said roll means, said head means being formed of a material having a coefficient of thermal expansion higher than the coefficient of thermal expansion of the material forming said roll means, wherein:

said head means places said roll means under radial compression at ambient temperature so as to cancel at least a portion of tension stress in said roll means created by heating said roll means and said head means.

7. The assembly of claim 6, wherein:

said roll means engages said head means at planar interfaces.

8. The assembly of claim 6, wherein:

said roll means engages said head means at planar interfaces; and said stress in said roll means includes circumferential stress caused by differential thermal expansion of said roll means and said head means; wherein:

said circumferential stress at a selected operating temperature for said roll means and said head means is about zero.

9. The assembly of claim 6, wherein said roll means comprises a cylinder having first and second opposed ends, said ends being substantially planar, and said head means comprises two disks, wherein said disks are forced against said ends by means extending lengthwise of said roll.

10. The assembly of claim 6, wherein:

said roll means comprises a cylinder having first and second opposed ends, said ends being substantially planar;

said head means comprises two disks, said disks being forced against said ends; and the material forming said cylinder comprises granite and the material forming said disks comprises steel.

11. The assembly of claim 6, wherein:

said roll means comprises a cylinder having said first and second ends, said ends being substantially planar, and said head means comprises two disks, said disks being frictionally engaged with said ends by axially exerted force; and wherein:

each of said disks further includes a journal for rotatably supporting said cylinder and said heads.

12. The assembly of claim 6, wherein:

said end surfaces are planar surfaces; and said head means comprises two disks, wherein said disks are forced against said planar surfaces by axially applied force, wherein:

said disks induce radial compression in said cylinder at temperatures beneath a preselected temperature.

13. The assembly of claim 12, further comprising:

a plurality of axially parallel longitudinal bores in said cylinder and in said disks, at least a portion of said bores in said cylinder being aligned with at least portion of said bores in said disks; and tension means positioned in at least some of said aligned bores, said tension means interconnecting said disks, wherein said tension means cause said disks to press against said ends of said cylinder.

14. The assembly of claim 13, wherein:

said stress in said roll means is circumferential stress caused by differential thermal expansion of said roll means and said head means; wherein:

said circumferential stress at a selected operating temperature for said roll means and said head means is about zero.

15. The assembly of claim 14, wherein said tension means comprise steel rods or cables.

16. An improved press roll assembly of the type having a unitary cylindrical roller having opposite axial ends, a head positioned at each axial end of the roller, a plurality of tensioned tie-rods extending between said heads and axially through the roller, the tie-rods being adapted to draw the heads against the roller to place the roller under axial stress, and the tie-rods being spaced radially away from the axis of the roller; wherein the improvement comprises:

said heads having been heated to a temperature above the roller temperature and not cooled to the temperature of said roller until after said heads have been drawn against the roller, wherein said roller body is under radial compression at ambient temperatures so as to cancel at least a portion of tension stress in said roll created by heating the press roll assembly.

17. The assembly of claim 16 wherein:

said roll ends engage said heads at planar interfaces.

18. The assembly of claim 17, wherein:

said stress in said roll includes circumferential stress caused by differential thermal expansion of said roll and said heads, wherein:

said circumferential stress at a selected operating temperature is about zero.

19. The assembly of claim 18 wherein:

said roll comprises granite and said heads comprise steel.

20. The assembly of claim 16, wherein:

said stress in said roll includes circumferential stress caused by differential thermal expansion of said roll and said heads, wherein:

said circumferential stress at a selected operating temperature is about zero.

* * * * *